United States Patent [19]

Artt

[11] 4,094,266

[45] June 13, 1978

[54] ELEVATOR AUDIBLE SIGNALING DEVICE

[76] Inventor: Donald P. Artt, 37090 Jordan, Mt. Clemens, Mich. 48043

[21] Appl. No.: 789,613

[22] Filed: Apr. 21, 1977

[51] Int. Cl.[2] ..... B66B 3/00

[52] U.S. Cl. ..... 116/64; 116/100; 335/205

[58] Field of Search ..... 116/64, 100, 68, 95; 340/21, 274; 187/1 R, 56; 335/205

[56] References Cited

U.S. PATENT DOCUMENTS

| | | | |
|---|---|---|---|
| 377,403 | 2/1888 | Oakley | 116/68 |
| 2,600,581 | 6/1952 | Schenendorf | 116/100 X |
| 3,451,373 | 6/1969 | Fox et al. | 116/100 X |
| 3,596,021 | 7/1971 | Saul | 335/205 X |
| 3,710,369 | 1/1973 | Takabashi | 335/205 X |

*Primary Examiner*—Daniel M. Yasich
*Attorney, Agent, or Firm*—Basile and Weintraub

[57] ABSTRACT

An audible signaling device for elevator cars of the type having an access opening and a door slideably carried by the elevator car and movable from a closed position to an open position. The audible signaling device comprises a housing mounted to the elevator car door and movable therewith. The housing includes a striker actuated gong which is operated in response to a pivotally mounted lever arm which, in turn, causes the striker to engage the gong when the door is moved to the open position. A magnet is positioned with respect to the open door such that the pivotally mounted lever arm engages the magnet and actuates the gong signaling the opening of the door. In one embodiment of the invention the magnet is located at the main floor entry to the elevator car such that, upon opening of the elevator car door, the gong is actuated to signal that the car is at the main floor. In a second embodiment of the invention the magnet is carried on the movable elevator car and is adapted to actuate each time the elevator car door is opened.

4 Claims, 5 Drawing Figures

ELEVATOR AUDIBLE SIGNALING DEVICE

BACKGROUND OF THE INVENTION

I. Field of the Invention

The present invention relates to elevators and, in particular, to an audible sounding device for elevator cars to provide an audible signal that the elevator car door has opened.

II. Description of the Prior Art

Heretofore numerous devices, alarms and indicators have been devised for elevators for the purpose of providing a means for advising the users as to when the elevator is in operation or as to when the elevator car has reached a particular level. Examples of such prior art apparatuses are disclosed in U.S. Pat. Nos. 150,321; 350,146; 318,202; 377,403; 407,590; and 356,461. Other examples of alarm systems known to the inventor include the alarms disclosed in U.S. Pat. Nos. 150,388; 2,735,397; and 3,710,369. While each of the abovementioned United States Patents discloses devices and apparatuses relevant to applicant's invention, it is believed that applicant's invention constitutes a patentable improvement thereover.

SUMMARY OF THE INVENTION

The present invention, which will be subsequently described in greater detail, comprises an audible signaling device particularly adapted to be mounted on a movable door of an elevator car for engagement with a fixed magnet to actuate a gong carried by the signaling device to indicate the arrival of the elevator car at a particular floor.

It is therefore the primary object of the present invention to provide a new and improved elevator audible signaling device which is simple in its design and construction and, thus, inexpesive to manufacture, install and maintain.

Other objects, advantages and applications of the present invention will become apparent to those skilled in the art of elevator audible signals devices when the accompanying description of one example of the best mode contemplated for practicing applicant's invention is read in conjuction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
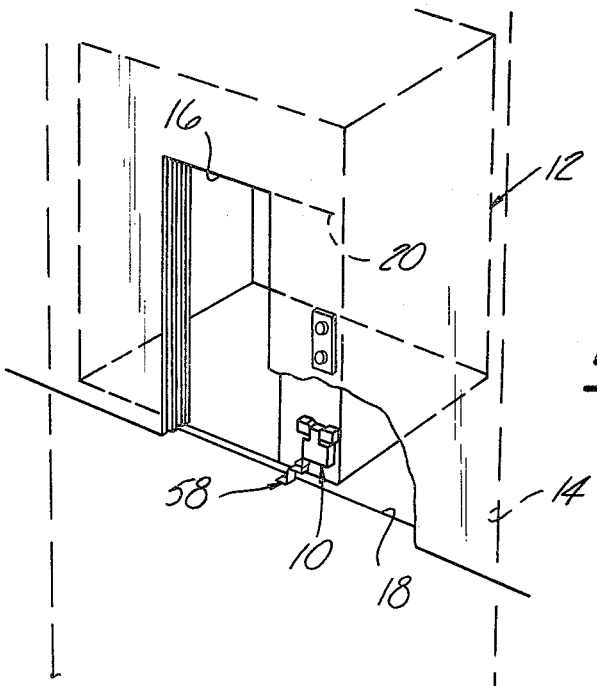
FIG. 1 is a perspective view of an elevator car employing one example of the present invention in the form of an audible signaling device.

Referring now to the drawings and, in particular, to FIG. 1 wherein there is illustrated one example of the present invention in the form of an elevator audible signaling device 10. The device 10 has particular application to conventional elevator cars 12 of the type which are vertically movable in an elevator shaft 14 to permit the dispatch of passengers through an access opening 16 to a floor level 18. As is conventional, a building may have a plurality of floors 18, including a main floor, through which the users of the elevator cars 12 have access to the street level and a plurality of floors above or below the main floor, depending upon the particular design of the building. The elevator car 12 includes a movable elevator door 20 of the conventional type which slides from a closed position closing the access opening 16 to the opened position illustrated in FIG. 1 wherein access to the elevator car 12 may be had. In FIG. 1 the audible signaling device 10 is mounted to the outside surface of the elevator door 20 and is movable therewith from its closed position to the opened position illustrated. The device 10, which will be described in greater detail hereinafter, includes a gong 33 which is actuated by a permanent magnet 50 when the elevator door 20 is shifted to its opened position. In the embodiment illustrated, the permanent magnet 50 is attached to the floor 18; and upon opening of the door 20 and the passage of the device 10 over the permanent magnet 50, the audible signaling device 10 is actuated. It should be noted that in selected applications the permanent magnet 50 may be mounted only on the main floor of the building such that the device 10 is actuated only upon the elevator car's 12 reaching the main floor. This is a particular merit when the convenience of blind people is considered, as the positioning of the elevator car 12 on the main lever needs to be communicated to such bline people by means of suitable audio devices. The prior art, attempting to accomplish this objective, has generally been through expensive and complicated electronic arrangements which have proven to be inadequate in that they have been known to break down frequently and are expensive to repair and maintain.

In other embodiments of the invention the fixed magnet 50 may be attached to the floor still (FIGS. 1 and 2) of the elevator car 12 such that is it brought into close proximity to the audible signaling device 10 each time the door 20 opens, and thus the device 10 is actuated at each floor 18. The main level may be provided with two such magnets 50 to cause a double actuation of the device 10 so as to provide the users with a distinct and different signal to announce the arrival of the elevator car 12 at the main floor.

Figure 3:
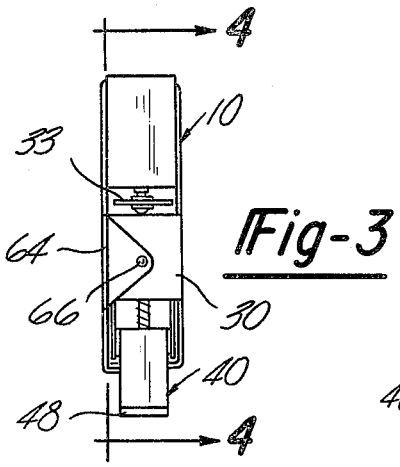
FIG. 3 is a left-side elevational view of the audible signaling device illustrated in FIG. 2 of the drawings.
Figure 2:
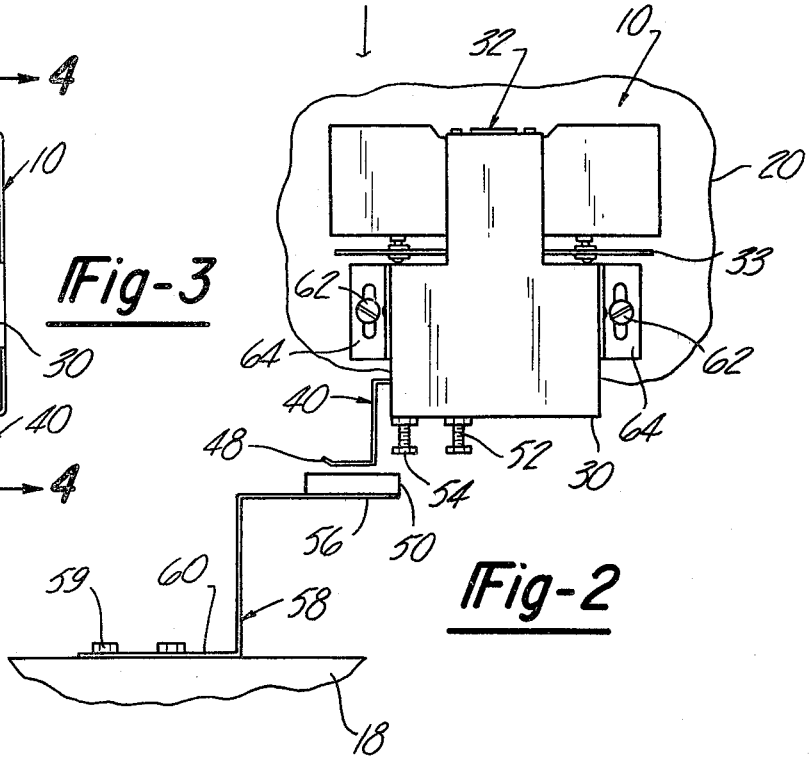
FIG. 2 is an enlarged, fragmentary view of the audible signaling device carried by the elevator car illustrated in FIG. 1 of the drawings.
Figure 4:
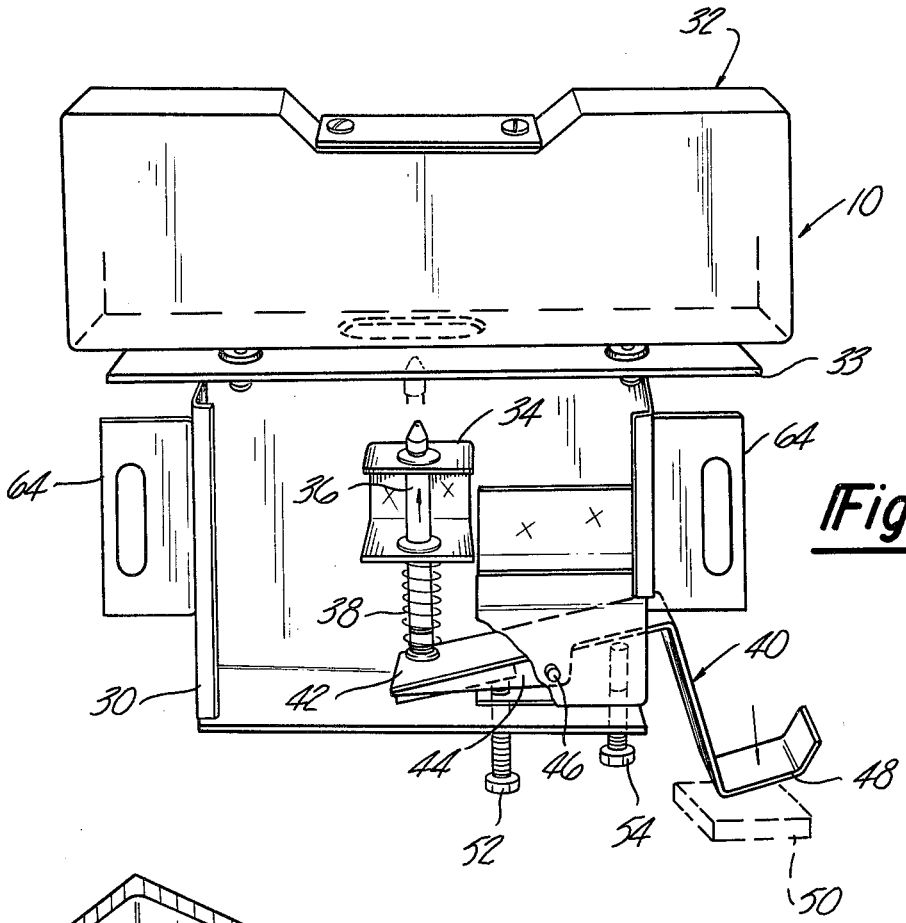
FIG. 4 is a fragmentary, partially sectioned view of the audible signaling device as seen from Line 4—4 of FIG. 3.

Referring now to FIGS. 2 through 4 for a description of the audible signaling device 10, it can be seen that the device 10 comprises a housing 30 which mounts a gong or flat bell assembly 32. As can best be seen in FIG. 4, the interior of the housing 30 has a U-shaped bracket 34 which reciprocally mounts a striker post 36 that is spring biased to a position away from the flat gong 33. A suitable coil spring 38, disposed around the lower portion of the striker 36 accomplishes this purpose. The housing 30 further pivotally mounts a striker lever 40. The lever 40 has a leg member 42 which includes side flanges 44 through which a suitable pivot pin 46 extends to pivotally mount the striker lever 40 to the interior of the housing 30. The extended end of the lever leg 42 is adapted to abut the lower end of the striker post 36 and forcibly move the striker arm 36 upwardly into an intermittent engagement with the flat gong 33 to cause a ringing effect in the conventional manner. The opposite end of the lever 40 has a flange 48 which is adapted to engage the permanent magnet 50 in a manner which will be described hereinafter. The housing 30 further includes a tone adjustment screw 52 which controls the amount of movement of the lever 40 and, thus, the tone or loudness of the singaling device 10. A clearance adjusting screw 54 is carried in the bottom surface of the housing 30 and limits the amount of movement of the lever flange 48 towards the fixed magnet 50 and thereby provides a predetermined clearance between the two elements when they are in their activated position, as will be described hereinafter.

As can best be seen in FIG. 2, the fixed magnet 50 is mounted on one leg 56 of an S-shaped bracket 58. The lower leg 60 of the bracket 58 is secured by suitable fasteners 59 to either the floor 18 or the sill of the elevator car 12 to accomplish one of the aforementioned purposes. It is improtant to realize that the magent 50 should be positioned with respect to the flange 48 of the pivotable lever 40 in such a manner that when the door 20 opens and the actuating audible signaling device 10 is brought adjacent to the magnet 50, the flange 48 is positioned over the magnet 50 and actuated under the magnetic force of the fixed magnet 50 to actuate the gong 33. The magnet 50 should be so positioned that the flange 48 does not pass by the magnet 50. If the same does, this would result in a second actuation of the audible signaling device 10 as the door closes, and the flange 48 would pass the magnet for the second time, resulting in a double actuation of the device 10. It is therefore desired that the relative position of the magnet 50 and the flange 48 be that as illustrated in FIG. 2 of the drawings when the door 20 is in its opened position. Thus, when in the position illustrated, the 50 magnet causes the flange 48 to move to a lower position, forcing the striker post 36 to engage the flat gong 33 and actuate the signaling device 10. While the door 20 is in its opened position, the flange 48 (that is, the lever 40) is in its pivoted position and may not result in a second ringing of the device 10 until the door 20 has completely closed and then reopened at another floor or at the main floor, as desired.

As can best be seen in FIGS. 2, 3 and 4 of the drawings, the audible device 10 is mounted to the wall of the door 20 by means of threaded fasteners 62 that extend through L-shaped side brackets 64 mounted on either side of the housing 30. As can be seen in FIG. 3, the brackets 64 are pivotally attached to the side walls of the housing 30 by suitable attaching means 66. Thus, when it is necessary to attach the signaling device 10 to the left- or right-hand side of the elevator car door 20, the same may be simply accomplished by rotating the brackets 64 180° whereby the same device 10 may be used for right- and left-hand mounting purposes in a very simple and unique manner.

Figure 5:
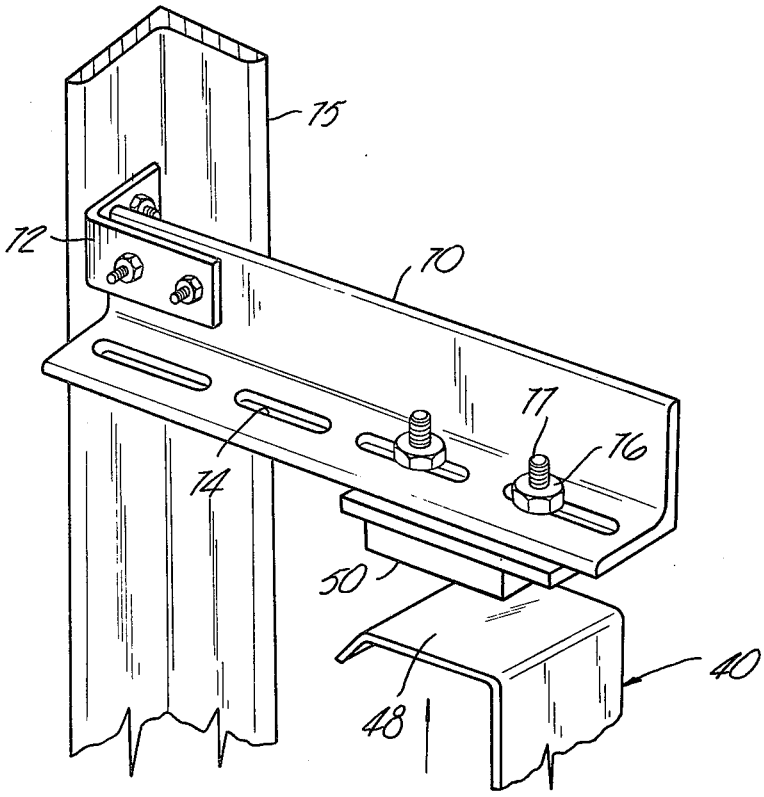
FIG. 5 is a fragmentary, perspective view of an alternate means for mounting a permanent magnet utilized in actuating the audible signal device illustrated in FIGS. 1 through 4 of the drawings.

Referring now to FIG. 5 for a brief description of the manner of mounting the permanent magnet 50 to the elevator shaft 14. This may be accomplished by means of an L-shaped bracket 70 which is provided with suitable fasteners 72 for attaching the bracket to the strut angle 75, which is a conventional component in elevator shafts 14. The magnet 50 is then positioned outwardly toward the elevator door such that the flange 48 of the device 10 may be passed thereunder, as illustrated. The elongated slots 74 in the L-shaped bracket 70 provided a simple means for varying the position of the magnet 50 which is secured thereto by means of bolts 77 extending through the slots 74 and engaging nuts 76. It should also be noted that in the FIG. 5 embodiment the signaling device 10 is mounted in a position which is 180° with respect to the position illustrated in FIGS. 2 and 4 of the drawings.

It should be understood that the device 10 may be mounted in either of the positions described on the door 20 of the elevator car 12 to achieve the desired result of informing the elevator car users of the fact that the elevator car 12 has reached a floor and the door is open.

It can thus be seen that the present invention has provided a new and improved elevator car signaling device which is simple in its construction and design, easily mounted to existing elevators lacking such apparatus, and one that is easily incorporated into newly constructed elevator cars and elevator shafts.

What is claimed is as follows:

1. An audible signaling device for an elevator car of the type having an access opening and a door slideably carried by said elevator car across said opening and movable from a closed position to an opened position, said audible signaling device comprising:

a housing means having a gong;

a striker carried by said housing means and operable upon engagement to strike said gong;

a magnetic responsive lever biased arm pivotally mounted in said housing for engaging said striker to cause said striker to strike said gong, said lever arm being movable when brought adjacent to a magnet;

said magnet comprising at least one permanent magnet mounted on a floor for actuating said lever arm to move toward engagement with said striker, means on said housing means coacting with the lever arm for maintaining said lever arm in a pivoted position while said lever arm is adjacent said magnet;

said housing means being mounted to said door of said elevator car such that, upon opening of said elevator car door, said lever is moved adjacent said magnet and activated to strike said striker, said magnet being so positioned that said lever remains in said pivoted position until said door commences to close.

2. The audible signaling device defined in claim 1 wherein said magnet is mounted to said car and movable therewith whereby said audible signaling device is actuated each time said door is opened.

3. The audible signaling device defined in claim 1 wherein said magnet is provided on each floor of a elevator shaft through which said elevator car passes such that said audible signaling device is actuated upon the opening of said door at each floor.

4. The audible signaling device defined in claim 1 wherein said magnet is mounted on only a main floor of the building housing said elevator car whereby said audible device is actuated only upon the opening of said elevator car door on the main floor of said building.

* * * * *